US010106298B2

(12) United States Patent
Watkins et al.

(10) Patent No.: US 10,106,298 B2
(45) Date of Patent: Oct. 23, 2018

(54) OUTSERT FOR ALUMINUM WINE BOTTLE

(71) Applicant: ALECO CONTAINER, LLC, Arvada, CO (US)

(72) Inventors: Evan D. Watkins, Evergreen, CO (US); Michael Atkinson, Westminster, CO (US); Scott Coors, Arvada, CO (US)

(73) Assignee: Aleco Container LLC, Arvada, CO (US)

( * ) Notice: Subject to any disclaimer, the term of this patent is extended or adjusted under 35 U.S.C. 154(b) by 0 days.

(21) Appl. No.: 15/478,035

(22) Filed: Apr. 3, 2017

(65) Prior Publication Data

US 2017/0283127 A1 Oct. 5, 2017

Related U.S. Application Data

(60) Provisional application No. 62/317,771, filed on Apr. 4, 2016.

(51) Int. Cl.

| | |
|---|---|
| ***B65D 41/08*** | (2006.01) |
| ***B65B 7/28*** | (2006.01) |
| ***B65D 1/02*** | (2006.01) |
| ***B67B 3/20*** | (2006.01) |
| ***B65D 23/00*** | (2006.01) |

(52) U.S. Cl.

CPC ..... *B65D 41/08* (2013.01); *B65B 7/285* (2013.01); *B65D 1/0246* (2013.01); *B65D 23/00* (2013.01); *B67B 3/2066* (2013.01)

(58) Field of Classification Search

CPC ..... B65D 41/08; B65D 23/00; B65D 1/0246; B67B 3/2066; B65B 7/285

USPC .... 220/289, 296, 327, 315, 319; 215/40–55, 215/200–364

See application file for complete search history.

(56) References Cited

U.S. PATENT DOCUMENTS

| | | | | |
|---|---|---|---|---|
| 1,941,632 | A * | 1/1934 | Staniland | B65D 1/48 215/386 |
| 3,124,273 | A * | 3/1964 | Remington et al. | B65D 41/08 215/386 |
| 6,010,026 | A * | 1/2000 | Diekhoff | B21D 51/26 215/335 |
| 9,139,324 | B1 | 9/2015 | Watkins | |
| 2003/0116521 | A1* | 6/2003 | Chupak | B65D 1/0207 215/40 |

OTHER PUBLICATIONS

Watkins, Evan D.; Atkinson, Michael; Coors, Scott, U.S. Appl. No. 15/478,062, filed Apr. 3, 2017 for "Outsert for Swing Cap Assembly," 16 pages.

* cited by examiner

*Primary Examiner* — Kareen K Thomas
(74) *Attorney, Agent, or Firm* — William P. O'Meara

(57) ABSTRACT

An aluminum bottle outsert includes an annular inner surface configured to be received and supported on an upper neck portion of an aluminum bottle. The outsert also includes an annular outer surface that has a threaded portion adapted to receive a wine bottle screw top capping assembly.

6 Claims, 4 Drawing Sheets

OUTSERT FOR ALUMINUM WINE BOTTLE

This application claims the benefit of U.S. provisional patent application Ser. No. 62/317,771 of Evan Watkins, Scott Coors and Michael Atkinson entitled OUTSERT FOR ALUMINUM WINE BOTTLE, filed on Apr. 4, 2016, which is hereby incorporated by reference for all that it discloses.

RELATED APPLICATION

This application is related to U.S. provisional patent application Ser. No. 62/317,762 of Evan Watkins, Scott Coors and Michael Atkinson entitled OUTSERT FOR SWING CAP ASSEMBLY, filed on Apr. 4, 2016, and to a non-provisional application claiming the benefit thereof, U.S. Ser. No. 15/478,062 of Evan Watkins, Scott Coors and Michael Atkinson entitled OUTSERT FOR SWING CAP ASSEMBLY, filed on the same date as the present application, both of which are hereby incorporated by reference for all that is disclosed therein.

BACKGROUND

Glass wine bottles with aluminum screw off caps have been in use for many years. A capping assembly currently used on treaded wine bottles is referred to in the wine industry as a "Stelvin® type capsule" (referred to hereinafter as an "ST capsule" or simply "capsule"). This capping assembly, when Installed on a threaded glass wine bottle, creates the appearance of a conventional corked wine bottle with a metal foil wrapper/skirt. An ST capsule is a generally cylindrical, tubular aluminum member with an upper closed end and a lower open end. The tubular member has an internal diameter slightly larger than the diameter of the threaded end portion of the wine bottle. ST capsules are designed to be used with standardized bottle neck finishes including BVS finish BVP-GME 30.13 and BVS FINISH US-GPI 1680-03.

An ST capsule is applied by placing the open end of the capsule over the wine bottle neck and sliding the capsule down the neck until the closed end of the capsule contacts the top edge of the bottle. The capsule is then crimped into place with a rotating assembly that urges the top portion of the capsule against the threads of the bottle, causing the top portion of the capsule to form receiving threads that conform to the shape of the bottle threads. Once the capsule is installed, the capsule top portion may be tom away from the lower portion by hand twisting the top portion. The top portion of the capsule then functions as a screw off cap. Such ST capsules are commercially available from various sources, for example, Amcor Flexibles, 5425 Broadway Street, American Canyon, Calif., 94503, USA.

Another type of ST capsule, a "prethreaded ST capsule," is also available from Amcor. The prethreaded ST capsule has preformed threads in the capsule top portion and does not require on bottle crimping thread formation with a rotating assembly, as does the ST capsule described in the immediately preceding paragraph.

SUMMARY

The inventors have developed a tubular member (referred to herein as an "outsert") that is adapted for use with an unthreaded aluminum bottle. The outsert is mounted on a neck portion of the unthreaded aluminum bottle. This outsert, once mounted, acts like the threaded portion of a conventional threaded wine bottle. An ST capsule, unthreaded or prethreaded may be attached to the aluminum bottle/outsert assembly in the same way that conventional unthreaded or prethreaded ST capsules are attached to a threaded glass wine bottle. The aluminum bottle/outsert/ST capsule assembly then functions like a threaded wine bottle/ST capsule assembly, i.e., a threaded cap portion of the ST capsule may be screwed off, rupturing a perforated portion, to open the bottle. The cap portion then functions as a conventional screw on/screw off cap.

An aluminum bottle outsert Includes an annular inner surface configured to be received and supported on an upper neck portion of an aluminum bottle. An annular outer surface of the outsert has a threaded portion adapted to receive a wine bottle screw top capping assembly.

An aluminum wine bottle assembly includes an aluminum bottle that has a bottle neck portion that includes a constant diameter portion; a rolled larger diameter portion integrally formed with and positioned above the constant diameter portion: and a flared lower neck portion Integrally formed with and positioned below the constant diameter portion. The assembly also includes a bottle outsert mounted on the bottle neck portion below the rolled larger diameter portion. The outsert has a downwardly and outwardly flared inner surface portion engaged with the bottle flared lower neck portion. The outsert also has a threaded outer surface portion. An ST capsule is affixed to the outsert threaded outer surface portion.

A method of capping an aluminum wine bottle includes attaching an outsert to a neck portion of the bottle and attaching a wine bottle capping assembly to the outsert.

DETAILED DESCRIPTION

Figure 1:
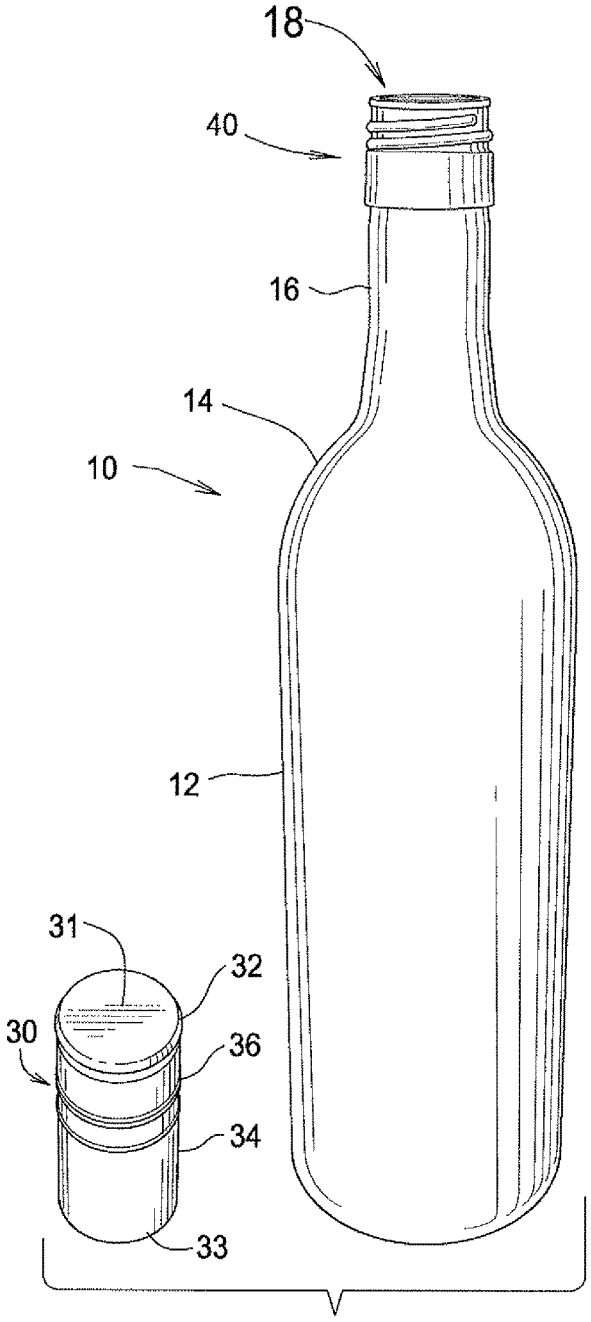
FIG. 1 is a front isometric view of an aluminum wine bottle with a wine bottle outsert mounted thereon and with an ST capsule positioned next to the bottle.

FIG. 1 is a front isometric view of an aluminum wine bottle 10. In this example embodiment, the aluminum wine bottle 10 has a constant diameter barrel portion 12, a varying diameter shoulder portion 14 and a varying diameter neck portion 16. A wine bottle outsert 40 is fixedly mounted on the bottle neck portion 16 below a rolled end portion 18 of the bottle neck 16. An ST capsule 30 that is to be mounted on the bottle 10 is positioned next to the bottle 10. The ST capsule 30 has a generally tubular shape with an upper closed end 31 and a lower end 33 that has a circular bottom opening. The capsule 30 has an upper, screw cap portion 32 and a lower, skirt portion 34 that is connected to the screw cap portion 32 by a perforated connection portion 36. The ST capsule may be a conventional ST capsule of the type used on glass wine bottles. In one example embodiment, the ST capsule 30 is a "crimp on the bottle" type ST capsule. In another example embodiment, the ST capsule 30 is a pre-threaded ST capsule.

Figure 2:
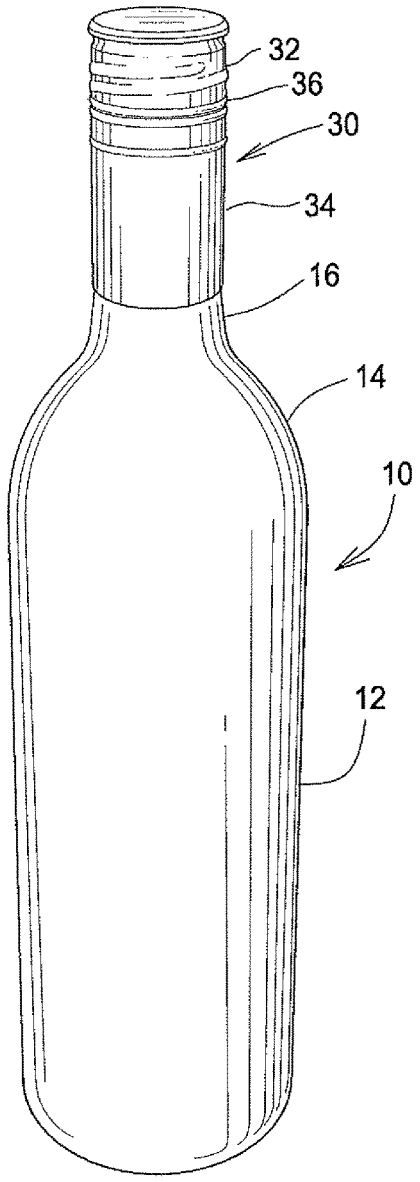
FIG. 2 is a front isometric view of an aluminum wine bottle with an ST capsule mounted thereon.

FIG. 2 is a front isometric view of an aluminum wine bottle 10 with the ST capsule 30 fixedly attached to it. In one example embodiment, the ST capsule is a "crimp on the bottle" type ST capsule and is attached to the outsert by crimping the cap portion 32 of the bottle onto the threaded outsert 40 with a rotating crimping assembly. In another example embodiment, the ST capsule is a prethreaded ST capsule and is attached to the outsert by screwing the ST capsule onto the outsert threads.

Figure 3:
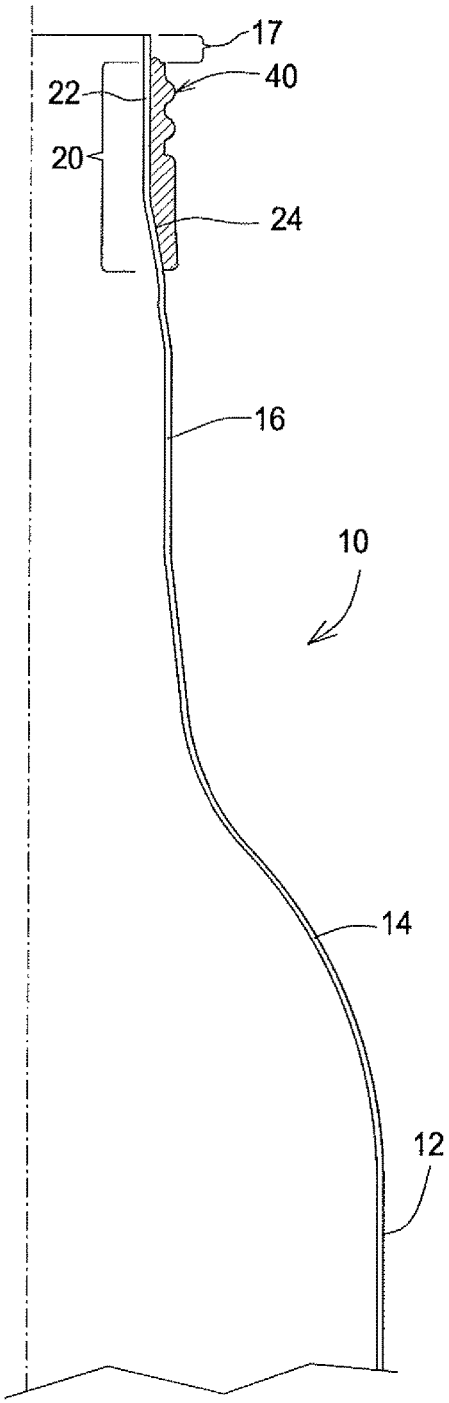
FIG. 3 is a cross-sectional elevation view of an upper portion of the aluminum wine bottle with an outsert positioned thereon, prior to curl formation.

FIG. 3 is a cross sectional elevation view of an upper portion of the aluminum wine bottle 10 with an outsert 40 loosely positioned thereon. The upper end of the bottle neck portion 16 has an outset mounting region 20 that includes a vertical, constant diameter region 22 and a lower flared region 24 in which the bottle neck diameter becomes progressively larger from the top to the bottom of the region 22. The outsert 40 is initially mounted on the bottle 10 by placing the outsert 40 over the end of the bottle 10 and sliding it downwardly to the position shown in FIG. 4 at which point the bottle neck diameter is sufficiently large to prevent further downward displacement of the outsert 40. In FIG. 3, a small, e.g. 0.115 in, axially extending annular portion 17 of the bottle 10 extends vertically above the outsert mounting region 20. In one example embodiment, the constant diameter region 22 has a diameter of around 0.89 in and an axial length of around 0.48 in, and the varying diameter region 24 has a maximum diameter of about 1.0 in and an axial length of around 0.25 in.

Figure 4:
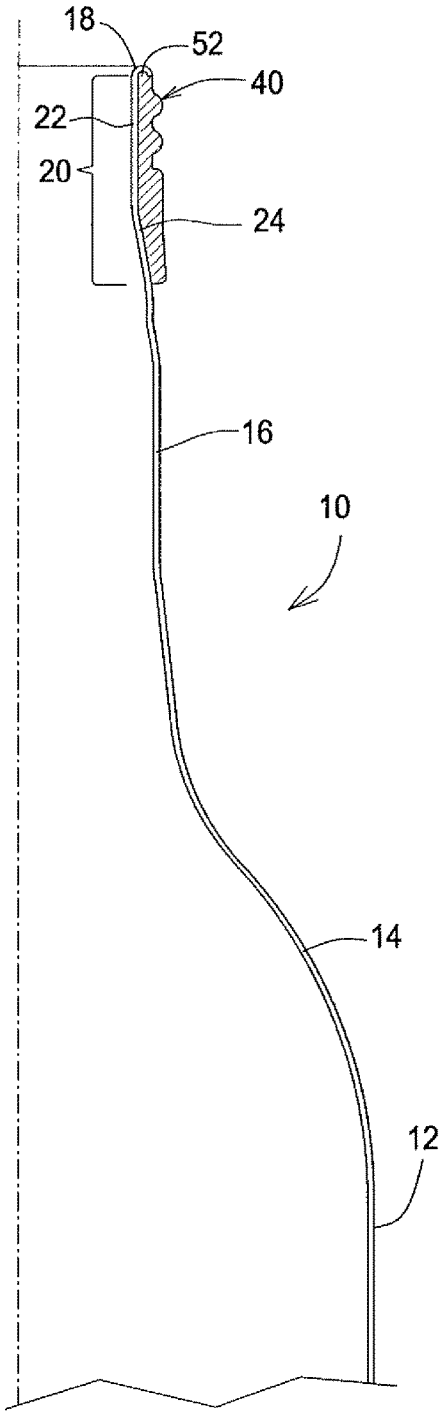
FIG. 4 is a cross-sectional elevation view of an upper portion of the aluminum wine bottle with an outsert fixedly mounted thereon after end curl formation.

FIG. 4 is a cross-sectional elevation view of the same portion of the aluminum wine bottle 10 as shown in FIG. 3, but with the outsert 40 fixedly attached to the bottle 10. As in FIG. 3, the flared portion 24 of the bottle mounting region 22 has engaged the inner surface of the outsert 40, preventing any further downward displacement thereof. Then, the annular tip portion 17 of the bottle neck 16, which is shown in FIG. 3, is curled to produce rolled/curled end portion 18. Annular rolled end portion 18, at its lower surface, engages the top annular surface of the outsert 40, preventing upward displacement of the outsert 40. The rolled/curled end portion 18 may be formed, for example, as described in U.S. Pat. No. 9,139,324 of Watkins et al. for METAL BOTTLE TYPE CONTAINER WITH INSERT/OUTSERT AND RELATED METHODOLOGY, issued Sep. 22, 2015, which is hereby incorporated by reference for all that it discloses.

Figure 5:
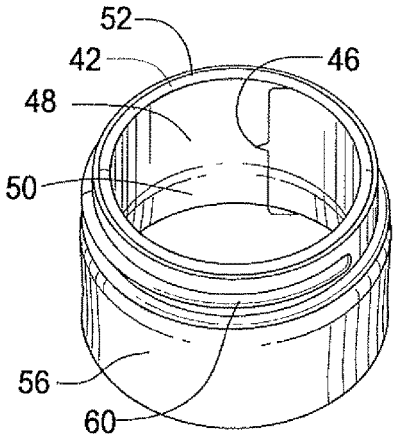
FIG. 5 is a top isometric view of the wine bottle outsert of FIG. 1.
Figure 6:
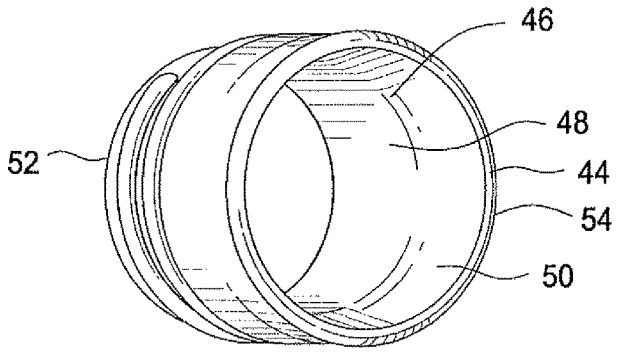
FIG. 6 is a bottom isometric view of the wine bottle outsert.
Figure 7:
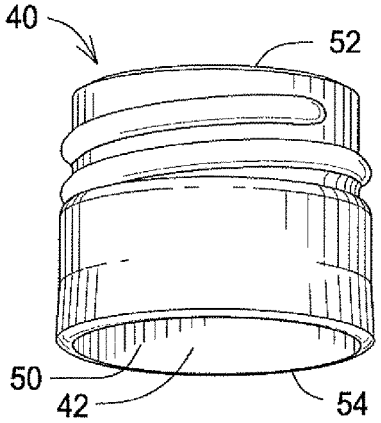
FIG. 7 is another bottom isometric view of the wine bottle outsert.
Figure 8:
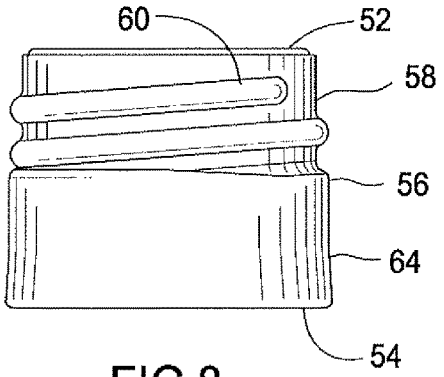
FIG. 8 is a side elevation view of the wine bottle outsert.

FIG. 5 is a top isometric view of the wine bottle outsert 40; FIG. 6 is a bottom isometric view thereof; and FIG. 7 is another bottom isometric view thereof. FIG. 8 is a side elevation view thereof. In one example embodiment, the outsert is made of a relatively high strength plastic, for example Polyethylene Terephthalate ("PTE") or other relatively high strength material such as ceramics. As shown by FIGS. 5-8, the outsert 40 is a tubular member with a generally cylindrical outer surface 56 comprising a threaded upper portion 58 with a continuous thread 60 and an unthreaded lower portion 64. The outsert 40 has upper and lower open ends 42, 44 defined by upper and lower terminal edges 52, 54. The outsert 40 has an annular inner surface 46 with an upper constant diameter region 48, and a lower outwardly flared region 50. The upper terminal edge 52 of the outsert is adapted to engage the rolled end 18 of the bottle 10, preventing the outsert 40 from moving upwardly. The outwardly flared Inner surface region 50 of the outsert 40 is adapted to engage the flared region 24 of the bottle 10 to prevent downward travel of the outsert and maintain it in the position shown in FIG. 2. In one example embodiment, the overall axial length of the outsert 40 is 0.831 in and the thread pitch is 7 threads per inch.

Figure 9:
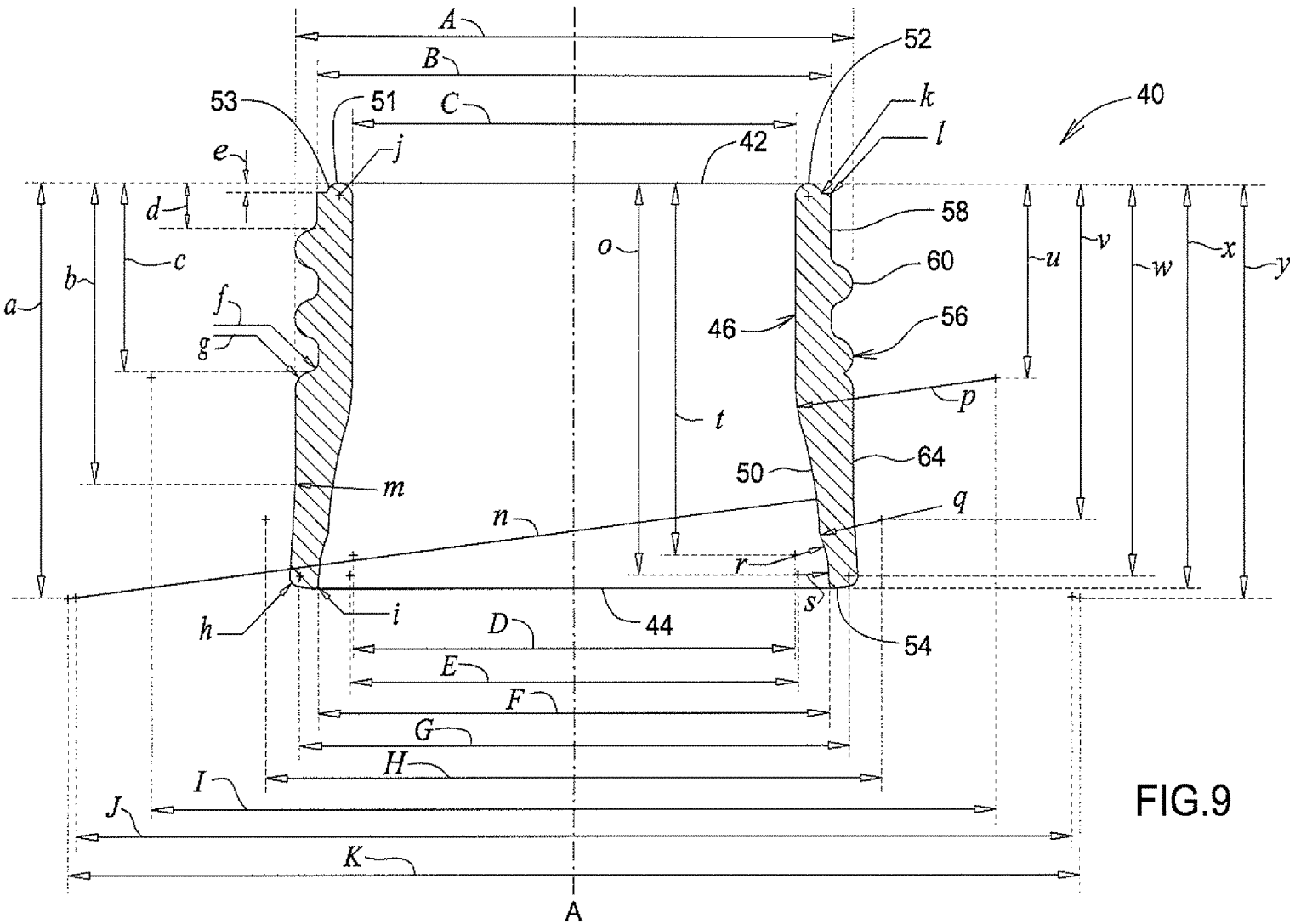
FIG. 9 is a cross-sectional elevation view of the wine bottle outsert.

FIG. 9 is a cross-sectional elevation view of one embodiment of the outsert 40. The outsert dimensions, in inches, are Indicated in Table 1 below, for one example embodiment.

TABLE 1

| | Letter | | | | | | | | | | |
|---|---|---|---|---|---|---|---|---|---|---|---|
| | a | b | c | d | e | f | g | h | i | j | k |
| Value | .854 | .619 | .389 | .090 | .020 | .031 | .031 | .020 | .010 | .026 | .003 |
| | Letter | | | | | | | | | | |
| | l | m | n | o | p | q | r | s | t | u | v |
| Value | .005 | .50 | 1.50 | .810 | .400 | .125 | .063 | .063 | .768 | .399 | .696 |
| | Letter | | | | | | | | | | |
| | w | x | y | A | B | C | D | E | F | G | |
| Value | .812 | .835 | .861 | 1.114 | 1.027 | .886 | .887 | .898 | 1.024 | 1.098 | |
| | Letter | | | | | | | | | | |
| | H | | I | | J | | K | | | | |
| Value | 1.235 | | 1.689 | | 2.00 | | 2.02 | | | | |

To produce the bottle/ST capsule assembly shown in FIG. 2, the outsert 40 is slipped over the aluminum wine bottle upper uncurled end 22, as shown in FIG. 3. The flared region 24 of the bottle neck portion 16 acts as the lower limit of travel of the outsert 40. A small axial length, e.g., 0.115 in, of the annular terminal end 17 of the bottle neck portion 16, FIG. 3, is then formed into a rolled/curled region 18 that engages the upper edge portion 52 of the outsert preventing its upward displacement. In one embodiment, as best shown in FIGS. 3 and 7, the upper edge portion 52 comprises an annular nose portion 51 integrally connected to an annular step or ledge portion 53. As shown in FIG. 4 the bottle curl portion 18 is rollingly/curlingly deformed over these portions 51, 53 of the upper edge portion 52, forming a smooth seam at the Interface of the terminal edge of curl portion 18 and the outsert annular ledge portion 53.

Next the circular bottom opening of the ST capsule 30 is placed over the outsert 40 and the ST capsule 30 is moved axially downwardly relative the outsert 40 and bottle neck portion 16 until the closed end 31 of the capsule 30 engages the curled/rolled portion 18 of the bottle neck portion 16. The ST capsule 30 is then rollingly crimped onto the outsert 40 and bottle neck portion 16 by a machine in the same manner as when it is crimped to the threaded end of a conventional threaded glass bottle. This crimping action forms corresponding female threads in the upper portion 32 of the capsule that provides a twist off cap. In an example embodiment in which the ST capsule 30 is a screw on type ST capsule, the capsule it is displaced downwardly until the threaded portion of the capsule 30 reaches the threaded portion of the outsert 40. Then the capsule 30 is screwed on to the outsert 40. With either the crimp on or the screw on type ST capsule 30, the perforated connecting portion 36 of the capsule is broken when a consumer twists off the upper portion 32. The upper portion 32 then acts as a recloseable twist cap.

Figure 10:
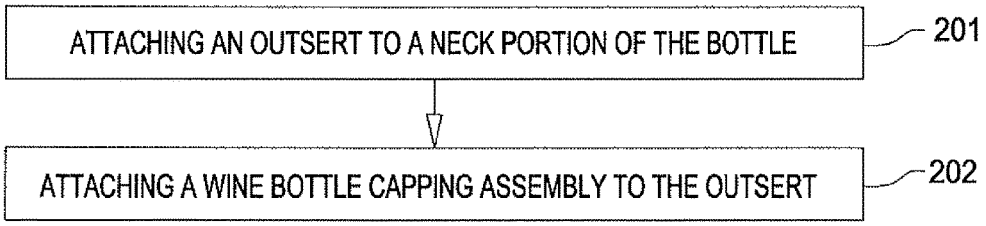
FIG. 10 is a flow chart of a method of capping an aluminum wine bottle.

FIG. 10 is a flow chart for a method of capping an aluminum wine bottle. The method includes, as shown at block 201, attaching an outsert to an aluminum bottle neck portion. The method also includes, as shown at block 202, attaching a wine bottle capping assembly to the outsert.

Although certain embodiments of metal wine bottle assemblies with twist off capping assemblies and related components and methods have been expressly described in detail herein, alternative embodiments thereof will occur to those skilled in the art after reading this disclosure. The language of the appended claims is intended to be construed broadly to cover all such alternative embodiments, except to the extent limited by the prior art.

What is claimed is:

1. An aluminum wine bottle assembly comprising:

an aluminum bottle having a bottle neck portion comprising:

a constant diameter portion;

a rolled larger diameter portion integrally formed with and positioned above said constant diameter portion; and a flared lower neck portion integrally formed with and positioned below the constant diameter portion; and a bottle outsert mounted on said bottle neck portion below said rolled larger diameter portion, said outsert having a downwardly and outwardly flared inner surface portion engaged with said bottle flared lower neck portion, said outsert having a threaded outer surface portion; and a CT capsule affixed to said outsert threaded outer surface portion.

2. The wine bottle assembly of claim 1, said outsert having a cylindrical inner surface portion positioned above said outsert downwardly and outwardly flared inner surface portion.

3. The wine bottle assembly of claim 2, said upper generally cylindrical portion of said outsert inner surface portion being positioned radially opposite said outsert threaded outer surface portion.

4. The wine bottle assembly of claim 3, said outsert further comprising an annular top edge surface having an annular projecting nose portion and an annular ledge portion positioned radially outwardly of said annular nose portion.

5. The outsert of claim 4, said roiled larger diameter portion of said bottle neck portion being curled over said outsert top edge surface nose portion with said annular ledge surface receiving an edge portion of said rolled larger diameter bottle neck portion in abutting relationship therewith.

6. The outsert of claim 1, said outsert threaded outer surface portion having a Stelvin®-type wine bottle capping assembly mounted thereon.

* * * * *